United States Patent [19]

Best et al.

[11] 4,249,779

[45] Feb. 10, 1981

[54] ROTATING CUTTING DRUM HAVING TAPERED AND CURVED CONVEYING SURFACE

[75] Inventors: Gerd F. Best, Sprockhoevel; Norbert B. Weikert, Dortmund, both of Fed. Rep. of Germany

[73] Assignee: Krampe & Co. Fertigung in Bergbaubedarf GmbH, Hamm, Fed. Rep. of Germany

[21] Appl. No.: 33,833

[22] Filed: Apr. 27, 1979

[30] Foreign Application Priority Data

Sep. 28, 1978 [DE] Fed. Rep. of Germany ..... 2842131

[51] Int. Cl.[3] ..... E21C 25/10

[52] U.S. Cl. ..... 299/81; 299/87

[58] Field of Search ..... 299/43, 45, 46, 87, 299/89, 81; 175/394

[56] References Cited

U.S. PATENT DOCUMENTS

| | | | |
|---|---|---|---|
| 3,085,795 | 4/1963 | Snipe et al. | 299/87 |
| 4,022,286 | 5/1977 | Gill | 299/81 |

FOREIGN PATENT DOCUMENTS

| | | | |
|---|---|---|---|
| 2647171 | 5/1978 | Fed. Rep. of Germany | 299/87 |
| 56521 | 12/1968 | Poland | 299/43 |
| 1349873 | 4/1974 | United Kingdom | 299/87 |
| 2000539 | 1/1979 | United Kingdom | 299/81 |

*Primary Examiner*—Ernest R. Purser

*Attorney, Agent, or Firm*—Michael J. Striker

[57] ABSTRACT

A cutting tool, particularly for a mining machine includes an elongated support having a first end and an axially spaced second end. The support also includes an outer circumferential surface having at the first end a first outer dimension and at the second end a second outer dimension which is smaller than the first dimension. The outer surface includes a portion adjacent to one of the ends and having a non-linear configuration with an exterior dimension which gradually decreases in direction from the above-mentioned one end towards the other of the first and second ends. A plurality of cutting units are located on the outer circumferential surface of the support along a line circumferentially embracing the support.

20 Claims, 2 Drawing Figures

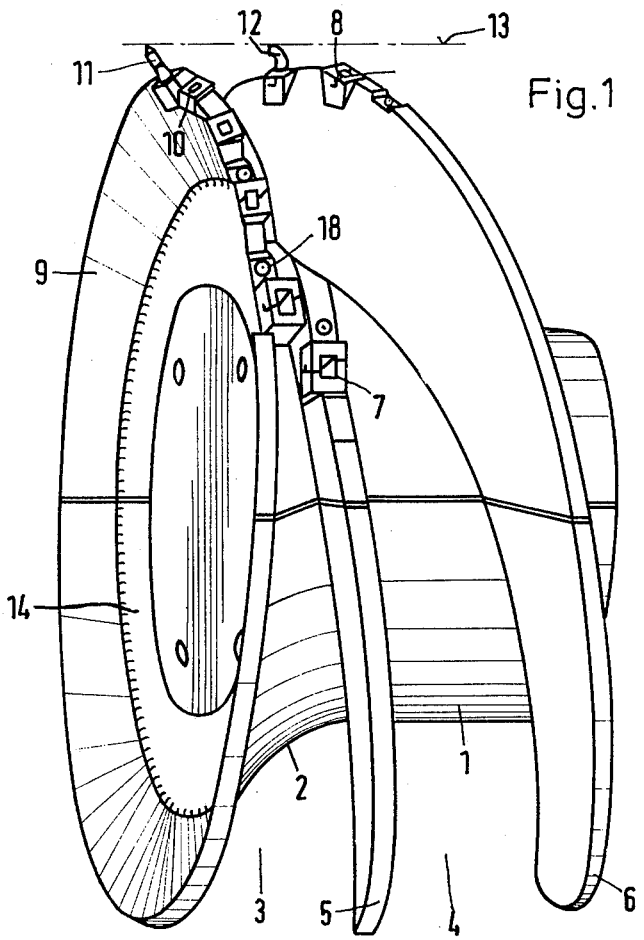
Fig.1
Fig.2
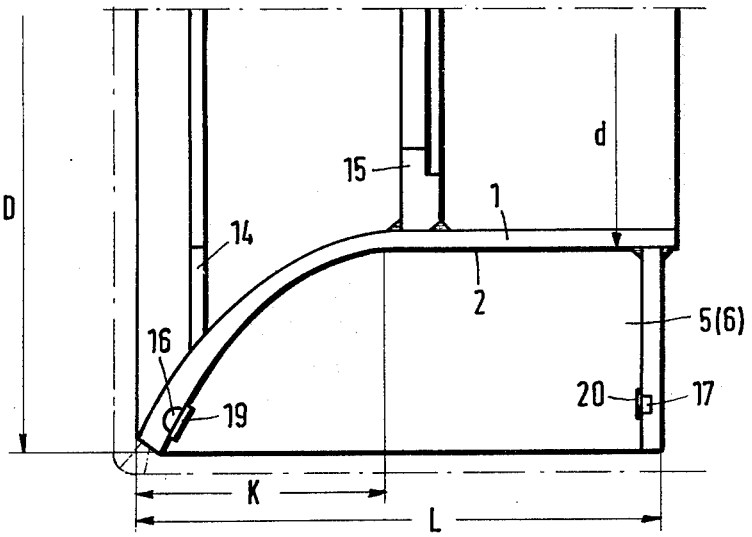

ROTATING CUTTING DRUM HAVING TAPERED AND CURVED CONVEYING SURFACE

BACKGROUND OF THE INVENTION

The present invention relates to winning machines for winning coal, minerals, and the like.

More particularly, the present invention is concerned with a rotating head for such a winning machine.

It is known in the prior art to provide a power loader which has a cutting tool such as a rotating head (usually a drum or drums) armed with picks or some form of cutter bits. Such a rotating head includes a tubular support and one or more blades which may extend helically about the circumference of the tubular support. The blades are rigidly connected (e.g., welded) to the outer surface of the support. A plurality of cutting units are mounted equally spaced on the blades. Each of the cutting units includes a pick holder rigidly connected (e.g. welded) to the blade and a pick detachably fixed in the holder. Cutting is achieved by the picks which extend from the periphery of the blades towards a working (i.e., mining) face of the material to be mined. The tubular support has one open end which faces the working face and which is closed by an end face plate.

It has been also suggested to provide the rotating head with a conical locking ring which is welded to the end face plate and extends outwardly away therefrom towards the working face. The outer periphery of the locking ring may also be provided with a plurality of the cutting units similar to those provided on the blades. The picks, which are fixed in the corresponding holders welded to the outer periphery of the locking ring, extend towards the working face. Due to the conical locking ring the contact of the end face of the rotating head with the working face is considerably reduced as opposed to a rotating head having the end face entirely planar. Obviously, the forces of the engagement between the end face of the rotating head and the working face and the frictional losses in such an engagement are considerably reduced in the case of the rotating head having the conical locking ring. Accordingly, the effectiveness of the cutting process is increased, whereas the dust development during the cutting process is reduced.

It has been recognized, that any inclination of the end face of the rotating head from the planar configuration leads to improving of the cutting process. It is further advantageous to maintain a cone angle of the end face, that is an angle between any imaginable line extending radially along the end face and the axis of the rotating head, substantially below 90°. In practice, the cone angle is between 30° and 85°; however, a preferable range of inclination would be between 50° and 70°. Quite sufficient results have been obtained with the cone angle of 60°.

It is very difficult and time consuming to displace such a rotating head in the mine. However, it is often necessary to remove the head from the mine to the ground surface, for example, for repairing purposes.

However, such displacement is not always possible or very easy to accomplish, for example, due to the unpredictable and, therefore, uncontrollable swelling of the floor of the mine which leads to narrowing of the main passage of the mine. Thus, in order to remove the head from the mine, it becomes necessary to excavate additional material from the mine only to widen the main passage. Obviously, any additional excavation is relatively complicated and expensive. Thus, the cutting (i.e. mining) process, which is quite expensive by itself, becomes even more expensive due to the above-mentioned additional excavations.

The blades on the tubular support have the same outer diameter, so that the picks which are mounted on the blades constitute a common generatrix. Therefore, the spaces defined by the corresponding surfaces of the blades on the one hand and the respective portions of the outer surface of the tubular support on the other hand are equal to one another. This leads to the fact that the removed material moves along a relatively wide section all the way until it reaches a conveyor which results in an undesired comminuting of the removed material into small particles. Besides, since the removed material moves always along the passage of the same cross-section there might be a situtation where the removed material develops a plug in this passage, which plug unavoidably results in negative consequences for the whole power loader.

In German Offenlegungsschrift No. 2647171 it has been suggested to provide the tubular support with a conical linear outer surface having a first end which faces the working surface and an axially spaced second end which faces away from the working face of the mine. In this case, the first end has the largest outer diameter, whereas the second end has the smallest outer diameter. Thus, the passage for the removed material at the first end of the tubular support is smaller than that at the second end of the support. Advantageously, the transporting of the removed material in direction from the first end, that is from the working face, towards the second end of the tubular support and onto the conveyor located adjacent to the second end of the tubular support is considerably facilitated due to the cone angle of the outer surface of the support.

However, it has been recognized, that the linear extension of the outer surface of the tubular support is not always satisfactory with respect to the requirements made to a reliable, simple and fast transporting of the removed material from the working surface towards the conveyor. In fact, the linear increase of the cross-section of the passage for the removed material has been found to be the reason of the unsatisfactory conditions during transporting of the removed material from the working face.

The rotating head in accordance with the German Offenlegungsschrift No. 2647171 consists of two halves which may be connected to each other right in front of the working face. Obviously, this fact considerably facilitates the displacement of the head itself. Especially, the displacement of the head back onto the ground surface becomes considerably less complicated.

However, in order to repair such a head, the latter still has to be moved from the mine onto the ground surface. Such a displacement of the head causes significant expenses comparing with an initial purchase-cost of the head. Thus, for example, the repair- and displacement expenses may sometimes exceed the purchase-cost of a new head. Nevertheless, it has never been suggested, even in the case of the one-piece head, to provide such a rotary head that can be assembled underground and left there, for example, after being broken.

The assembling of the rotating head in accordance with the above-mentioned German Offenlegungsschrift No. 2647171 is very complicated. The tubular-support halves are connected to each other by screws which after a relatively short time of use corrode significantly due to the direct contact with underground water. Thus, the corroded screws can be moved (i.e. unscrewed) only upon applying thereto a significant pulling force (i.e. torque) which is a quite difficult task to accomplish, especially if considered the limited free space in the mine.

Moreover, the separate conical locking ring additionally increases the cost of the rotating head, since the ring has to be connected to the conical tubular support. Obviously, additional operations of making (or purchasing) the locking ring and welding this ring onto the support correspondingly increase the overall cost of the rotating head.

SUMMARY OF THE INVENTION

It is a general object of the present invention to avoid the disadvantages of the prior art cutting tools, such as rotating heads.

More particularly, it is an object of the present invention to provide a disposable rotating head for winning machine, particularly for an underground mining.

Another object of the present invention is to provide such a rotating head having a support with an outer surface thereof and one or more blades, which are so shaped as to facilitate the displacing of the removed material from a working face of a mine.

In pursuance of these objects and others which will become apparent hereafter, one feature of the present invention resides in a cutting tool, particularly for a winning machine, which comprises an elongated support having a first end, an axially spaced second end, and an outer circumferential surface which has at the first end a first outer dimension and at said second end a second outer dimension which is smaller than said first dimension. The outer surface further includes a portion adjacent to one of said ends and having a non-linear configuration with an exterior dimension which gradually decreases in direction from said one end towards the other of said ends.

In accordance with another feature of the invention, a plurality of cutting units which are located on said outer circumferential surface of said support along a line circumferentially embracing said support.

In yet another feature of the invention, the support includes two halves which are connectable to each other so as to constitute together the elongated support. Each half of the support is provided with formations which, when the halves are in assembly with each other, constitute a conical locking ring, passages for supplying a hydraulic fluid onto the outer surface of the support and a blade which circumferentially embraces the support along said line. All these formations may be integrally connected to the respective halves of the supports, so that when the halves are in assembly with each other all the above-mentioned additional parts, such as the locking ring, the hydraulic fluid passages, etc. are formed without any additional labor or expenses. The halves may be welded to each other, as well as, for example, parts of the blade located on each of the respective halves of the support.

In still another feature of the invention, the separate half of the support may be integrally connected with the corresponding parts of the conical locking ring, the blade, etc. It is possible, for example, to cast a workpiece which would constitute the above-mentioned half with all above-mentioned parts. Obviously, this feature considerably reduces the relatively high cost of a prior art cutting tool all parts of which, such as the locking ring, the blade, etc., are separate and, therefore, have to be somehow connected to the support.

The cutting tool (i.e., head) in accordance with the present invention is quite inexpensive, so that it becomes less expensive to dispense with a broken tool, for example, to leave it in an exhausted (i.e., finished) working passage, rather than to remove this tool from the mine, and repair the same on the ground surface.

Since the cutting tool in accordance with the present invention practically does not have any screws, bolts or the like, the service and the maintenance of the tool is considerably reduced. Obviously, the cutting tools, which have the screws or any other similar connecting elements, have to be periodically cleaned or the corroded connecting elements to be replaced so as to prevent potential interlocking of the separate parts. Since, in the underground conditions corrosion (in more or less active form) is unavoidable, then it becomes very time consuming and rather expensive to maintain and serve such a cutting tool. However, in accordance with the present invention, the above mentioned periodical attention and maintenance of the connecting elements become unnecessary since substantially all the connecting elements are eliminated and the separate halves of the support are welded together.

In a further feature of the invention, the support has a first end portion, including said first end, of a relatively thick cross-section so as to facilitate formation of the conical ring thereon. The conical ring is also provided with the cutting units.

In yet another feature of the present invention, the outer surface of the support is so curved, that said portion adjacent to said first end constitutes with the conical ring and the respective end face of the blade the smallest passage for displacing the removed material from the working face. This passage increases towards the second end of the outer surface of the support. Such a configuration facilitates the displacement of the removed material from the section having a relatively small free space (i.e. from the section adjacent to said first end) to the section having a relatively large free space for accommodating the removed material therein. Obviously, the cutting tool having the curved outer surface of the support is considerably more effective in displacing the removed material from the working face than the cutting tool having the linear conical outer surface of the support as described, for example, in the above-mentioned German Offenlegungsschrift No. 2647171.

In still further feature of the invention, each cutting unit must include a pick holder rigidly mount on the respective blade (e.g. welded thereto) and a pick installed in said pick holder and extending outwardly away therefrom. The support may be cast with at least one groove. This groove may be covered from outside by a covering plate which is welded to the support so as to constitute with the groove the hydraulic fluid passage.

In yet a further feature of the invention, the support may be integrally connected with a mounting flange which may be so shaped and dimensioned as to receive driving means, e.g. an output shaft of a motor.

The flange may be adapted to receive an intermediate element which, for example, compensates for the difference between the corresponding dimensions of the flange cast together with the support and the output shaft of the motor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view of a cutting tool in accordance with the present invention; and FIG. 2 is a schematic longitudinal sectional view of a portion of the cutting tool shown in FIG. 1.

DESCRIPTION OF THE PREFERRED EMBODIMENTS

Referring now to the drawings and first to FIG. 1 thereof, it may be seen that the reference numeral 1 designates a tubular support having an outer circumferential surface 2. The support 1 has a length designated by L—see FIG. 2. Along the length L, the outer surface 2 of the support 1 constitutes an exponential curve. The outer surface 2 has a first end (a left-hand end as viewed in FIGS. 1 and 2) which faces a working face (not shown) of the material to be mined and which has an outer diameter designated by D. The outer surface 2 has a second end (a right-hand end as viewed in FIGS. 1 and 2) which faces oppositely to the first end, i.e. away from the working face and which has an outer diameter d. The first outer diameter D of the first end is the largest outer diameter of the outer surface 2. The second outer diameter d of the second end is the smallest outer diameter of the outer surface 2. Thus, the outer surface 2 gradually decreases in direction from the first end towards the second end thereof.

It may be seen in FIG. 2, that the outer surface 2 along a portion having a length K decreases in a non-linear sudden manner, for example, constituting a hyperbolic curve starting at the first end having the largest outer diameter D and decreasing until this portion reaches the outer diameter d, that is at the end of the portion having the length K. In a preferred embodiment of the present invention, the length K of this portion constitutes one-third of the length of the whole support 1, measured from the first end having the largest outer diameter D. Along a remaining portion having a length L-K, the outer surface 2 may remain horizontal (see FIG. 2), that is having the outer diameter d. However, it is also possible to reduce the outer diameter of the remaining portion having the length L-K gradually unitl it reaches the smallest outer diameter d at the second end of the surface 2.

The outer surface 2 is provided with helical blades 5 and 6 which extend circumferentially outwardly away from the surface 2. Thus, a free space 3 constituted by the first end, the corresponding curved portion of the outer surface 2 and the respective end face of the blade 5 is considerably smaller than a free space 4 constituted by the respective opposite end faces of the blades 5 and 6 and the substantially horizontal portion of the outer surface 2. Obviously, the removed material contained in the relatively smaller space 3 moves fast along the outer surface and the helical blades 5 and 6 towards and into the relatively larger space 4, that is in direction away from the working face and onto a conveyor (not shown).

The blades 5 and 6 constitute an upright plate which is rigidly connected, for example welded, to the outer surface 2 of the support 1. Each blade is provided at its outer periphery with a plurality of pick holders 7 and 8 which are equally spaced on the respective blades 5 and 6. The holders 7 and 8 may be welded to the outer periphery of the blades 5 and 6.

The support 1 is provided with an annular portion 9 which is conically open towards the working face. The annular portion 9 is integrally connected to the rest of the support 1. The outer periphery of the annular portion 9 is also provided with a plurality of pick holders 10. Each pick holder, of the holders 7, 8 and 10, is provided with a pick (only two picks 11 and 12 are shown for the sake of simplicity of the drawing) which extends outwardly away from the respective pick holders. The picks are designed to conduct cutting of the material, e.g. coal. The tips of the picks are arranged at one end the same cylindrical generatrix 13. It is to be noted, that the outer peripheries of the blades 5 and 6 and the outer periphery of the annular portion 9 are also arranged at a common generatrix which is not shown in the drawing for the sake of simplicity of the same.

The reference numeral 14 is used to designate a locking ring which may be welded to the support 1. A connecting flange 15 may also be welded to the inner surface of the support 1 for supporting a motor (not shown). The open end of the support 1 may be closed by a closing plate (see FIG. 1).

The references 16 and 17 are used to designate passages for supplying a hydraulic fluid (e.g. water) through respective spraying nozzles so as to prevent dust development during transporting the removed material. For the sake of simplicity of the drawing, the reference numeral 18 designates only one spraying nozzle. The hydraulic fluid passages 16 and 17 constitute grooves closed by respective plates 19 and 20 (see FIG. 2).

In the preferred embodiment of the present invention the hydraulic-fluid-spraying passages are formed during casting of the support 1. Obviously, it is advantageous to form the locking ring 14 and the connecting flange 15 also during the casting process, that is of one piece with the support 1. Any other connecting openings for the hydraulic fluid may be formed. Thus, it is not necessary any more to form the conical ring 9 as a separate element from the support 1.

The support 1 may consist of two separate parts, i.e. halves, which can be cast separately. It is to be understood, that the respective halves of the support may be cast in one part with the respective parts of the blades 5 and 6. In this case, when the respective halves of the support are in assembly with each other, the respective parts of the blades constitute together the blades 5 and 6. The respective parts of the blades 5 and 6 are welded together when the halves of the support 1 are in assembly, thus holding the halves of the support 1 together in the assembled position.

Instead of welding the respective parts of the blades 5 and 6 together or in addition thereto, the respective halves of the support 1 may be screwed together by means of screws (not shown) which connect the inner flanges of the respective halves of the support to each other. These screws do not have to be unscrewed (i.e. detached) for the sake of making repair of the cutting tool (i.e. rotating head). Moreover, the separate halves of the support 1 can be brought underground and then be assembled right in front of the working face of the material to be mined. In this case, the blades may be welded also underground during assembling the halves of the support 1. However, the respective parts of the blades 5 and 6 may be welded (if they were not cast together therewith) to the respective halves of the support 1, before the same is brought underground. In the case of assembling the whole arrangement underground, the parts of the blades 5 and 6 have to be prepared beforehand, so that operators have only to weld the blades 5 and 6 (or the parts thereof) on the halves of the support 1, which parts may be, for example, additionally connected to each other by means of the abovementioned screws or any other similar connecting elements.

It must be understood that the present invention is by no means limited to the number of blades. Obviously, there may be provided a greater (i.e. more than two) or a smaller (i.e. one) number of blades. It is also possible, to cast the halves of the support 1 in one piece with only portions of the blades. In this case, the portions are cast with connecting elements for connecting thereto the remaining portions of the blades. Obviously, the remaining portions of the blades may be attached to the support 1 in a fast and simple manner.

It will be understood that each of the elements described above, or two or more together, may also find a useful application in other types of a cutting tool, differing from the types described above.

While the invention has been illustrated and described as embodied in a cutting tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting tool, particularly for a winning machine, comprising an elongated support having a front end adapted to face a working face of a material to be worked, a rear end axially spaced from said front end and adapted to face away from the working face of the same, and an outer circumferential surface extending between said front and rear ends, said outer circumferential surface including a portion adjacent to said front end and having a curved configuration which considerably diviates from a linear configuration, with an exterior dimension gradually decreasing in direction from said front end toward said rear end so that an exterior dimension of said portion at said front end is greater and an exterior dimensions of said portion at said rear end is smaller, to thereby provide for a reliable, simple and fast transportation of particles removed from the working surface of the material, in the direction from said front end toward said rear end of said support; and a plurality of cutting units located on said outer circumferential surface of said support along a line circumferentially embracing said support.

2. A tool as defined in claim 1, wherein said support is provided with at least one formation circumferentially embracing said support along said line and operative for mounting on a periphery of said formation said plurality of cutting units equally spaced from one another.

3. A tool as defined in claim 2, wherein said formation is integrally connected to said support.

4. A tool as defined in claim 3, wherein said formation is cast together with said support.

5. A tool as defined in claim 2, wherein each cutting unit includes a holder rigidly mounted on said formation and a pick fixed on said holder.

6. A tool as defined in claim 5, wherein said picks of said plurality of cutting units are arranged at a common cylindrical generatrix about the outer surface of said support.

7. A tool as defined in claim 1, wherein said support includes at least two separate halves adapted to be connected to each other underground.

8. A tool as defined in claim 1, and further including a conical locking ring rigidly connected to said first end of said support.

9. A tool as defined in claim 8, wherein said locking ring is integrally connected to said support.

10. A tool as defined in claim 1, and further comprising means for supplying a hydraulic fluid onto the outer surface of said support.

11. A tool as defined in claim 10, wherein said hydraulic-fluid-supplying means include a plurality of walls constituting a number of passages on the outer surface of said support for receiving and guiding the hydraulic fluid therethrough.

12. A tool as defined in claim 11, wherein said walls are integrally connected to said support.

13. A tool as defined in claim 1, wherein said portion forms an exponential curve.

14. A tool as defined in claim 1, wherein said portion forms a hyperbolic curve.

15. A tool as defined in claim 1, wherein said portion forms a parabolic curve.

16. A tool as defined in claim 1, wherein said support is a tubular element having a first end portion including said first end and having a first cross-sectional thickness, and a second end portion including said second end and having a second cross-sectional thickness smaller than said first cross-sectional thickness.

17. A tool as defined in claim 1, and further comprising a mounting flange for mounting driving means on the cutting tool.

18. A tool as defined in claim 17, wherein said flange is integrally connected to said support.

19. A tool as defined in claim 1, wherein said line circumferentially embracing said support is helix.

20. A tool as defined in claim 1, wherein said support has a section corresponding to said portion of said outer circumferential surface and at least one formation circumferentially embracing said outer circumferential surface along said line and operative for mounting on a periphery of said formation said plurality of cutting units, said support being formed as an integral member which includes said first-mentioned section integral with the remainder section of said support and with said formation and is provided with a plurality of passages for passing a hydraulic fluid.

* * * * *